United States Patent [19]

Danielson

[11] Patent Number: 4,660,297

[45] Date of Patent: Apr. 28, 1987

[54] DESORPTION OF WATER MOLECULES IN A VACUUM SYSTEM USING ULTRAVIOLET RADIATION

[76] Inventor: Philip Danielson, 5620 Main St., Downers Grove, Ill. 60516

[21] Appl. No.: 793,984

[22] Filed: Nov. 1, 1985

[51] Int. Cl.[4] ..... F26B 3/28

[52] U.S. Cl. ..... 34/4; 34/15; 34/92; 250/492.1

[58] Field of Search ..... 34/1, 4, 39, 92, 15; 250/492.1

[56] References Cited

U.S. PATENT DOCUMENTS

| | | | |
|---|---|---|---|
| 2,455,812 | 12/1948 | Schlesman | 196/94 |
| 3,457,655 | 7/1969 | Winkler | 34/15 |
| 3,538,616 | 11/1970 | Malling | 34/92 |
| 3,640,001 | 2/1972 | Ellison | 34/218 |
| 3,820,251 | 6/1974 | Abernathy | 34/202 |
| 4,050,412 | 9/1977 | Bautz | 118/642 |
| 4,135,098 | 6/1979 | Troue | 250/492 |
| 4,193,204 | 3/1980 | Nerod | 34/4 |
| 4,218,831 | 8/1980 | Harris et al. | 34/4 |
| 4,220,865 | 9/1980 | Silverman | 250/504 |
| 4,222,177 | 9/1980 | Mason | 34/4 |
| 4,297,583 | 10/1981 | Nerod | 250/453 |
| 4,363,176 | 12/1982 | Jargiello et al. | 34/4 |
| 4,408,400 | 11/1983 | Colapinto | 34/4 |

*Primary Examiner*—Albert J. Makay
*Assistant Examiner*—David W. Westphal
*Attorney, Agent, or Firm*—Marvin N. Benn; Milton S. Gerstein

[57] ABSTRACT

A method of desorbing water vapor molecules from the interior wall surfaces of a vacuum chamber by irradiating the inner wall surface by ultraviolet radiation. During the irradiation of the inner wall surfaces by the ultraviolet radiation, the vacuum chamber is kept under vacuum. The wavelength of the ultraviolet radiation is preferably a combination of two basic wavelengths: a first wavelength of 183 nanometers, and a second wavelength 254 nanometers. The ultraviolet radiation source is a conventional ultraviolet lamp. The lamp is connected to an exterior power source. After radiation the inner wall surface of the vacuum chamber with ultraviolet radiation, the desorbed water molecules are pumped away by the pumps of the vacuum system. Any wavelength falling within the ultraviolet band of the spectrum may be used for irradiating the inner wall surfaces of the vacuum chamber.

16 Claims, 2 Drawing Figures

DESORPTION OF WATER MOLECULES IN A VACUUM SYSTEM USING ULTRAVIOLET RADIATION

BACKGROUND OF THE INVENTION

The present invention is directed to a method and apparatus for desorbing water molecules adsorbed in the inner-wall surfaces of a vacuum chamber, to which a vacuum pump or pumps are connected in order to establish a vacuum therein. In order to establish a vacuum within a chamber, it is necessary to remove all gases contained in the chamber such as air and water molecules. The reason for the need to remove such gases is to reduce any partial pressures contributed by these extraneous gases. The removal of the air is quite simple, this being achieved by the action of the pump itself. The removal of the water molecules, however, is not so simple. Since water molecules are polar, there is a distinct distribution of charge within each molecule. Owing to this, there is an attraction between the ions of the chamber material, and the opposite charge associated with the polar molecule. A weak bond is thus formed, thus holding the water molecule to the surface of the material, which later on may be separated from the chamber wall to thus contribute to a partial pressure within the chamber. For this reason, it is advantageous to remove as much of the adsorbed water molecules from the interior of the vacuum chamber, to thus prevent any later contribution to partial pressure in the chamber. Techniques have been known by which the water molecules are given enough energy to break the weak bond binding it to the inner surface of the chamber, thereby breaking free from the inner surface, to thus be sucked away by the action of the pump or pumps associated with the vacuum system. Such prior art techniques have used sonar energy, by which ultrasonic waves have been directed to the outer, exterior surface of the vacuum chamber wall, by which the water molecules on the inner surface wall are excited and, thereafter, broken free from the chamber wall and eventually sucked away by the action of the pump. This is a time consuming process, and one that is not entirely successful in removing a desirable amount of the adsorbed water molecules.

Another method that has been employed to a greater degree of success, has been the use of heating the exterior wall surface of the vacuum chamber, which, by conduction, reaches the inner surface wall of the chamber, thereby thermally exciting the water molecules to thereby break the bond holding it to the chamber wall. Infrared radiation is one form that has been used for such thermal heating. However, this is also a very time-consuming process, one that requires specially-placed flanges and joints for connecting the equipment to the chamber, and special material that will withstand the high temperatures needed to create the energy necessary to break the weak bonds of the molecules. Further, this is a time consuming process, one which also does not lead to the general removal of all of the water molecules from the inner surface. The temperatures typically needed in this "bake-out" process may reach up to 450° C. Such high temperatures require metal gaskets that will withstand temperatures that would otherwise break down rubber materials, or at least cause them to vulcanize. There are rubber materials extant that can exist at such high temperatures, but they do not always share properties that make them easy to use with commercial vacuum-sealing techniques. When using the metal gaskets for the thermal bake-out process, it has been usual to use copper gaskets. However, these suffer from some drawbacks. They can only be used once, they require a great many flange-bolts with high bolting torque, and in general require too much work and are too expensive for most commerical processes.

There are other non-thermal processes by which water desorbtion may take place. One such non-thermal technique is the use of a bled-in gas, such as nitrogen, which is sucked into a partially-evacuated chamber during pump down. This bled-in gas transfers its energy to the water molecules on the inner surface of the vacuum chamber, which energy is achieved by the expansion of the gas upon its entry into the partial vacuum. Thus, the desorbed water molecules are carried away through the pumping system along with the bled-in gas. This system, in the process of desorbing the water molecules, has not met with much commercial success and use, because of the additional expense required for using an exterior gas such as nitrogen. Further, the amount of bled-in gas needed for desorbing the water molecules cannot usually be predetermined, and, even with the use of a large quantity of such bled-in gas, the results are random and unpredictable, since the partial vacuum of the chamber contributes to the energy imparted to the accelerated gas, such partial vacuum needed for a better performance not a priori being known. Further, the collisions of the nitrogen molecules are random, as is well known, thus meaning that there is a very good likelihood that some inner surface areas of the vacuum chamber would not be bombarded with deflected nitrogen molecules.

Another non-thermal technique that is known utilizes a de-focused electron beam generated within the vacuum chamber. As in the case with the bled-in nitrogen gas, the de-focused electron beam impacts against the adsorbed water molecules on the inner surface walls of the vacuum chamber, exciting them sufficiently to cause desorbtion. However, this technique has, to all intents and purposes, not been utilized commercially at all.

Hitherto, all of the prior art techniques above-described have used either the impartation of sufficient energy to the water molecules adsorbed on the inner surface of the vacuum chamber either by mechanical transference, as in the case of the use of the ultrasonic wave technique, or thermal energy, as in the case of bake-out and infrared radiation. The use of the electron beam would also fall within the category of the impartation of energy to the water molecules via mechanical excitation. All of these above-described prior art techniques are not only time consuming and less than successful in eliminating partial pressure within the vacuum chamber, but have proven to be, to one degree or another, less than satisfactory in commercial uses.

It would, therefore, be highly advantageous to develop a new process for the desorbtion of water molecules adsorbed to the inner wall surface of a vacuum chamber that would be quicker in its performance, cause a greater amount of desorbtion as compared with prior art techniques, and be relatively inexpensive as compared to currently-used prior art techniques. This would not only save in costs of achieving such desorbtion, but would, in the end, allow for even a greater degree of vacuum-attainment. Further, associated herewith, it would be advantageous, in combination with a reduction of cost in desorbing the water molecules from the vacuum chamber, to do so in a much more simple and easier way that would not require the inclusion of special gaskets, O-rings and the like, nor the special equipment associated with prior art techniques. If a new technique could be found that could do away with the expensive and/or technically-advanced equipment previously used for desorbtion of water molecules, not only cost savings, but the skill of the labor performing the process need not be at as high a level. Thus, a new technique by which the desorbtion of the water molecules from the interior surfaces of the vacuum chamber is achieved by relatively simple, inexpensive, and unskilled labor would prove to be highly advantageous and cost-effective.

It is, therefore, the main objective of the present invention to provide a novel method by which the desorbtion of water molecules can be achieved in a relatively simple manner utilizing standard and conventional hardware. The method of the present invention utilizes not thermal excitation or mechanical excitation, but electromagnetic excitation in the ultraviolet range.

SUMMARY OF THE INVENTION

It is, therefore, the main object of the present invention to provide a novel method, and an apparatus associated therewith, by which adsorbed water molecules may be desorbed from the inner wall surface area of a vacuum chamber, in a more efficient, less-costly manner than prior-art techniques.

It is also an object of the present invention to provide a novel method of desorbing water molecules from the inner surface area of a vacuum chamber using conventional technology that is readily available at low cost.

It is another object of the present invention to desorb the water molecules from the inner surface area of a vacuum chamber in a speedy and safe manner using an electromagnetic radiation not hitherto used for desorbing water molecules.

It is still another object of the present invention to accomplish such desorbtion of water molecules in a vacuum chamber by using ultraviolet radiation which is generated by one or more ultraviolet lamps installed within the at least partially evacuated vacuum chamber.

According to the method of the present invention, ultraviolet lamps or bulbs are emplaced within the vacuum chamber, which vacuum chamber is at least kept under a partial vacuum so that the ultraviolet radiation emitted by the lamps are caused to irradiate substantially the entire inner surface area of the vacuum chamber either by direct irradiation from the bulb itself or by the reflected rays thereof from the inner surfaces. In a preferred embodiment, one light bulb is used giving off ultraviolet radiation in two basic wavelengths: a first wavelength of 185 nanometers, and a second wavelength of 254 nanometers. In a modification thereof, only one of these wavelengths may be used in desorbing the water molecules from the vacuum chamber. Further, other wavelengths falling within the ultraviolet wavelength spectrum may be used.

One aspect of the novelty of the present invention lies in the fact that the water molecules are excited by photonic emission from a non-thermal and non-infrared radiant source. The ultraviolet light source mounted within the vacuum chamber is operatively connected to a conventional power source exteriorly of the outer wall surface of the vacuum chamber, appropriate power cables connecting the power source to the ultraviolet lamp.

Experiments have shown that when utilizing the ultraviolet radiation having a wavelength of 185 nanometers in combination with a wavelength of 254 nanometers, desorbtion of the water molecules from the vacuum chamber has been achieved in a time substantially less than conventional methods. During one such experiment, the vacuum chamber, having an inner surface area of 292 square inches, was substantially desorbed of water molecules within about three hours, compared to conventional rates of between nine and eighteen hours. For larger inner surface areas, more than one bulb of the same or different wavelength may be used.

BRIEF DESCRIPTION OF THE DRAWING

The invention will be more readily understood with reference to the accompanying drawing, wherein.

DETAILED DESCRIPTION OF THE INVENTION

Figure 1:
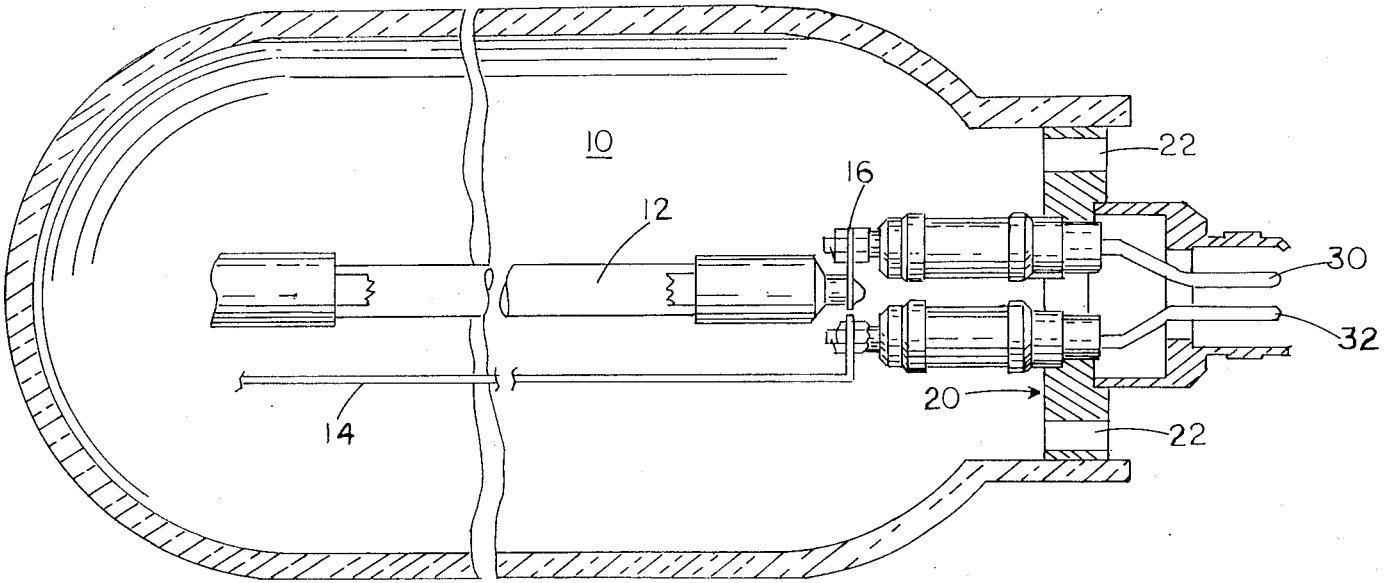
FIG. 1 is a schematic view showing the mounting of a conventional ultraviolet light source within the interior of a vacuum chamber for generating ultraviolet radiation in order to irradiate the inner surface area thereof.

It is known that water molecules are polar in that the charges thereof are separated. Owing to this polar effect, water molecules form weak bonds with ions, such as metallic ions. These weak bonds are sufficient enough to ensure that water vapor is adsorbed to the inner surface area of a vacuum chamber, thus often preventing sufficient, and the most economical, attainment of a vacuum. It has been calculated that this weak bond requires on the order of 140 kilocalories per mole to break it. It has been found, by the process of the present invention, that the use of ultraviolet radiation within the at-least-partially-evacuated chamber of a vacuum chamber, leads to fast and substantially total desorbtion of the water molecules from the inner wall-chambers of the vacuum chamber. According to one experiment, such desorbtion was achieved at a rate at one-third the rate of conventional techniques. For a vacuum chamber having an inner area of 292 square inches, and utilizing an ultraviolet lamp having output wattage of 4.3 watts, the water molecules within the vacuum chamber were substantially desorbed within a period of between three to six hours, as compared to conventional times of between nine and eighteen hours. The irradiation of the inner surface with ultraviolet radiation according to the present invention must be achieved by keeping the vacuum chamber under a vacuum by at least one or more pumps in the conventional manner. Typically, a high vacuum turbo-pump, in series with a low vacuum mechanical pump, separated by a copper/wool back streaming trap, is used. During one experiment thereof, the turbo-molecular pump had a calculated pumping speed of 23.8 liters per second at the chamber pumping port, which turbo-molecular pump was backed by a 3.5 cubic feet per minute mechanical pump. During the experiment, the chamber was fitted with a standard ionization gauge to measure total pressure at high vacuum, and a residual gas analyzer to measure partial pressures at high vacuum. The chamber was evacuated to $1.6\times1^{-5}$ toor (ion gauge reading) where the pressure was no longer dropping, which meant that the out-gassing rate of the internal surfaces of the chamber was equal to the pumping speed of the pumps. This was calculated using the formula $Q=SP$, where Q is torr-liters per second (gas flow), and S is the pumping speed in liters per second, and P is the pressure in torr. The residual gas analyzer showed that the chamber was leak-proof, meaning that there was no air whatsoever therein. This gas analyzer also showed that the gas load in the chamber was entirely water vapor molecules. Under these conditions, the gas load for these water vapor molecules was $2.75\times10^{-6}$ torr-liters per second. The ultraviolet bulb was then turned on, and the water vapor gas load was too high for either the ion gauge or the residual gas analyzer to operate. This indicated that the ultraviolet radiation was causing the water vapor molecules to desorb from the inner wall surface area of the chamber at such a rapid rate that the gas load exceeded the pumping speed of the pumps. This experiment used pumps having a substantially lower pumping speed than those that would be used under commercial conditions. Utilizing higher speed pumps would mean that the gas load effects would not have been able to have been measured. After approximately six minutes of ultraviolet radiation, the pressure dropped low enough, to approximately $3.4\times10^{-4}$, so that the ion guage and the residual gas analyzer could again be used. This showed a gas load of $3.22\times10^{-6}$ torr-liters per second per square inch. Even though some of the desorbed water vapor molecules had been pumped away, the gas load was still higher than before the use of the ultraviolet radiation, indicating that desorbtion was still occurring. The ultraviolet lamp was operated for approximately three hours, and the gas load equilibriated at 2.75 torr-liters per second. The lamp was then turned off, and the gas load dropped dramatically. After being off for fifteen minutes, the gas load measured $1.14\times10^{-7}$ torr-liters per second, and after being off for thirty minutes, the gas load measured $3.1\times10^{-8}$ torr-liters per second. The ultraviolet light source that was used had a combination of wavelengths. The first wavelength was 185 nanometers, and the second wavelength was 254 nanometers. The ultraviolet light source that was used was a commercially available ultraviolet bulb manufactured by VOLTARC TUBES, INC., 102 Lynwood Avenue, Fairfield, Conn., Model No. GLOT5½VH. This is a commercially available, standard ultraviolet lamp that is expressly designed for applications such as water purification and germicidal effects. The material of the vacuum chamber used during the experiment was made of stainless steel. However, other materials for the vacuum chamber would have no appreciable difference in the success rate of desorbtion. For example, a glass vacuum chamber would also be desorbed at a substantially higher rate than those provided by conventional techniques. Ultraviolet light source of a single wavelength alone has also been tested, and has shown superior results of desorbing water molecules as compared to prior-art techniques.

Figure 2:
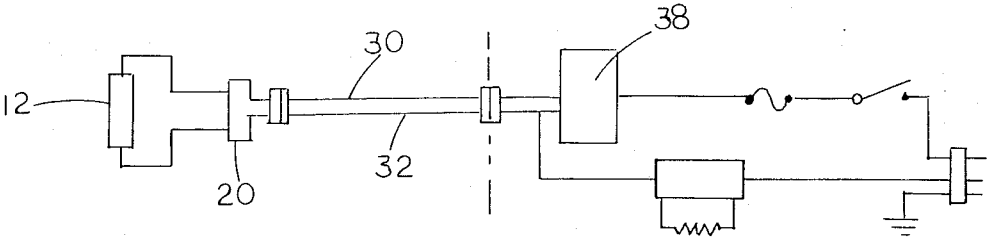
FIG. 2 is a schematic view showing the connection of the ultraviolet light source mounted within the vacuum chamber to an exterior power source.

FIG. 1 shows in schematic form the arrangement of the experiment above described. The vacuum chamber having an inner interior indicated by reference numeral 10 was provided with a conventional ultraviolet light bulb 12 with electrode 14 and electrode 16. Conflat vacuum flanges 20 were provided by which a vacuum feed-through 22 allowed the operative connection of the pump to the interior of the vacuum chamber. The electrode 14 is constituted by a mounting bracket. Cables 30 and 32 connected the ultraviolet bulb to a power source shown in FIG. 2. A ballast 38 is provided for providing constant wattage so that the starting voltage surge and circuit balance during normal arc operation is ensured in the conventional and well-known manner. The light bulb used in the above described experiment develops a 450 volt starting surge.

It has been found that by using ultraviolet radiation to desorb the water molecules from the inner chamber of a vacuum chamber lower pressures can be achieved in any existing system in the same amount of pumping time. Further, the very same pressure can be achieved in the vacuum chamber with lower pumping times. Further, it is within the scope and purview of the present invention to utilize ultraviolet radiation having wavelengths falling within the range of between 10 nanometers and 390 nanometers, the generally accepted range of ultraviolet radiation. It is noted that these rays are ultraviolet and not infrared or thermal rays. Infrared rays generally have wavelengths falling within the range of $7.8\times10^{-7}$ and $1\times10^{-3}$ meters, with thermal rays generally lying within the range of $1\times10^{-7}$ meters and $1\times10^{-4}$ meters. The above experiment was carried out and achieved successfully without any irradiation using infrared or thermal radiation. The only radiation involved was ultraviolet. The exact mechanism and process by with the adsorbed water molecules are given sufficient energy to break the bonds between them and the inner surface area of the vacuum chamber is not known. However, as the above experiment has shown, ultraviolet radiation has proven to be more than successful in desorbing water molecules from the vacuum chambers, as compared with prior art techniques. It is generally believed, that the excitation of the water vapor molecules adsorbed on the inner surface area of the vacuum chamber is achieved by photonic excitation thereof by the ultraviolet radiation.

The above-experiment as above described, used a vacuum chamber having a volume of 438 cubic inches and an inner surface area of 292 square inches. One light bulb above described was used to generate the ultraviolet radiation. For surface areas greater than 292 square inches, two such ultraviolet light bulbs may be used. Of course, the number of such ultraviolet light sources to be used, for any given surface area of a vacuum chamber, may be altered and changed depending on the circumstances. If a faster desorbtion rate is required, more than one light bulb may be used, or a light bulb of greater wattage may be used. If the desorbtion rate is to be increased at a significant rate, two or three such light bulbs may be used for a given surface area. The exact emplacement of the ultraviolet light bulb within the vacuum chamber may be advantageously determined. However, it is believed that the desorbtion rate is independent of the exact location of the light bulb, owing to the fact that much of the ultraviolet radiation is reflected by the inner surface wall area.

While a specific embodiment of the invention has been shown and described, it is to be understood that numerous changes, modifications and alterations thereof may be made without departing from the scope, spirit and intent of the invention, as set out in the appended claims.

What is claimed is:

1. A method for desorbing water molecules from the inner surface of a vacuum chamber, comprising:

generating ultraviolet radiation within the closed vacuum chamber, such that the ultraviolet radiation impinges upon the inner surface area of the vacuum chamber;

insuring at least a partial vacuum within the vacuum chamber for at least a portion of the time that said step of generating an ultraviolet radiation is performed; and pumping the desorbed water molecules released from the inner surfaces of the vacuum chamber to thereby remove the desorbed water molecules therefrom.

2. The method for desorbing water molecules from a vacuum chamber according to claim 1, wherein said step of generating ultraviolet radiation comprises generating said ultraviolet light radiation between 185 nanometers wavelength and 254 nanometers wavelength.

3. The method for desorbing water molecules from the inner surfaces of a vacuum chamber according to claim 1, wherein said step of generating ultraviolet radiation within said vacuum chamber comprises inserting an ultraviolet light source into the interior of said vacuum chamber, and connecting the ultraviolet light source to a power source for driving the light source.

4. The method for desorbing water molecules from the inner surfaces of a vacuum chamber according to claim 3, wherein said step of connecting said ultraviolet light source to a power source comprises connecting said ultraviolet light source to a power source exterior of the outer surface of said vacuum chamber.

5. The method for desorbing water molecules from the inner surfaces of a vacuum chamber according to claim 4, wherein said step of generating ultraviolet radiation in said vacuum chamber comprises generating ultraviolet radiation having a wavelength falling within the range of between 180 nanometers and 260 nanometers.

6. The method for desorbing water molecules from the inner surfaces of a vacuum chamber according to claim 1, wherein said step of generating ultraviolet radiation in said vacuum chamber comprises installing in the interior of said vacuum chamber a plurality of ultraviolet light bulbs.

7. The method for desorbing water molecules from the inner surfaces of a vacuum chamber according to claim 1, wherein said step of generating ultraviolet radiation in said vacuum chamber comprises generating a first ultraviolet light beam falling within the wavelength of between 245 nanometers and 260 nanometers, and generating another ultraviolet light beam falling within the wavelength of between 175 nanometers and 190 nanometers.

8. The method for desorbing water molecules from the inner surfaces of a vacuum chamber according to claim 7, wherein said steps of generating ultraviolet light beams within the range of between 245 nanometers and 260 nanometers, and 175 nanometers and 190 nanometers occur simultaneously.

9. The method for desorbing water molecules from the inner surfaces of a vacuum chamber according to claim 1, wherein said step of generating ultraviolet radiation in said vacuum chamber comprises supplying ultraviolet radiation having at least a combination of two basic wavelengths thereof.

10. In a vacuum system having a vacuum chamber formed by a hollow structure, pumping means operatively associated with the interior of said vacuum chamber for creating a vacuum therein, conduit means operatively connecting said pumping means to the interior of said vacuum chamber, the improvement comprising:

a source of ultraviolet radiation mounted in the interior of said vacuum chamber for irradiating the inner surfaces of said vacuum chamber with ultraviolet radiation;

a power source for supplying power to said ultraviolet source within said vacuum chamber, said power source lying exteriorly of the outer surface of said vacuum chamber; and means connecting said power source to said ultraviolet source, whereby ultraviolet radiation is caused to impinge upon the water molecules adsorbed in the inner surfaces of said vacuum chamber to thereby impart to the water molecules sufficient energy to break the weak bonds holding them to said inner surfaces.

11. The improvement according to claim 10, wherein said ultraviolet light source comprises at least one ultraviolet light bulb having an ultraviolet radiation falling within the wavelength of between 185 nanometers and 254 nanometers.

12. The improvement according to claim 10, wherein said ultraviolet light source comprises a first light bulb generating an ultraviolet beam having a wavelength falling within the range of between 175 nanometers and 190 nanometers.

13. The improvement according to claim 12, wherein said ultraviolet light source comprises a second light bulb generating ultraviolet radiation having a wavelength falling within the range of between 245 nanometers and 260 nanometers.

14. The improvement according to claim 10, wherein said means for generating ultraviolet radiation comprises means for simultaneously generating an ultraviolet beam of a first wavelength and a second ultraviolet beam of a second wavelength, said beams impinging upon the inner surfaces of said vacuum chamber to thereby desorb the water molecules adsorbed thereto, and being reflected by said inner surfaces to thereby insure that all the inner surface area of said vacuum chamber is irradiated with ultraviolet radiation.

15. A method of desorbing water molecules adsorbed in the inner surfaces of a vacuum chamber, comprising:

creating at least a partial vacuum in a vacuum chamber to which the inner surfaces thereof are to be desorbed of water molecules;

irradiating the inner wall surface area of the vacuum chamber with non-thermal, photonic, electromagnetic radiation; and pumping away the desorbed water molecules from the interior of the vacuum chamber created during said step of irradiating the inner wall surface area of the vacuum chamber.

16. The method according to claim 15, wherein said step of irradiating the inner surface wall area of the vacuum chamber comprises irradiating the surface area with ultraviolet radiation.

* * * * *